US011672385B2

(12) United States Patent
Youn et al.

(10) Patent No.: US 11,672,385 B2
(45) Date of Patent: Jun. 13, 2023

(54) DRYER STAND

(71) Applicant: LG ELECTRONICS INC., Seoul (KR)

(72) Inventors: Jekwang Youn, Seoul (KR); Youngdon Kim, Seoul (KR); Hyunsun Yoo, Seoul (KR); Jaehung Chun, Seoul (KR); Yousook Eun, Seoul (KR); Joogyeom Kim, Seoul (KR); Sungkyung Kim, Seoul (KR); Myongsun Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 862 days.

(21) Appl. No.: 16/576,516

(22) Filed: Sep. 19, 2019

(65) Prior Publication Data

US 2020/0085262 A1 Mar. 19, 2020

Related U.S. Application Data

(60) Provisional application No. 62/733,478, filed on Sep. 19, 2018.

(30) Foreign Application Priority Data

Jun. 13, 2019 (KR) ..... 10-2019-0070283

(51) Int. Cl.
*A47K 10/48* (2006.01)
*F24F 8/10* (2021.01)
(Continued)

(52) U.S. Cl.
CPC ..... *A47K 10/48* (2013.01); *A45D 20/12* (2013.01); *A45D 20/14* (2013.01); *F24F 8/10* (2021.01);
(Continued)

(58) Field of Classification Search
CPC .. A45D 20/12; A45D 20/14; A45D 2020/126; F24F 8/10; F24F 13/20;
(Continued)

(56) References Cited

U.S. PATENT DOCUMENTS

2013/0139400 A1* 6/2013 Fukano ..... A47K 10/48 34/202
2017/0326491 A1 11/2017 Jung et al.

FOREIGN PATENT DOCUMENTS

CN 2270133 Y 12/1997
JP S6028387 U * 2/1985
(Continued)

OTHER PUBLICATIONS

English translation, Han Young Hee, KR 20110017661 A, Feb. 2011 (Year: 2011).*
(Continued)

*Primary Examiner* — Jessica Yuen
(74) *Attorney, Agent, or Firm* — Birch, Stewart, Kolasch & Birch, LLP

(57) ABSTRACT

A dryer stand may include a base, a body having a first end connected to the base and a second end spaced upward from the base, a receptacle in which a dryer for discharging drying air may be mounted, a receptacle located in the second end of the body, the receptacle capable of receiving a dryer for discharging drying air, a fan located in the body to cause a flow of air to be introduced into the body and to be discharged outside the body, and an air purifier disposed in a flow path of the flow of air. The base may be provided with a suction hole or a discharge hole through which air sucked into the body by the fan passes, thereby purifying indoor air.

13 Claims, 20 Drawing Sheets

(51) Int. Cl.
*A45D 20/12* (2006.01)
*A45D 20/14* (2006.01)
*F24F 13/20* (2006.01)

(52) U.S. Cl.
CPC ..... *F24F 13/20* (2013.01); *A45D 2020/126* (2013.01)

(58) Field of Classification Search
CPC .... F24F 8/167; F24F 3/16; F24F 11/30; F24F 8/108; F24F 8/158; F24F 8/22; A47K 10/48; A01K 13/001
See application file for complete search history.

(56) References Cited

FOREIGN PATENT DOCUMENTS

| | | | | |
|---|---|---|---|---|
| KR | 10-2006-0019298 | A | | 3/2006 |
| KR | 20110017661 | A | * | 2/2011 |
| KR | 10-2015-0031643 | A | | 3/2015 |
| KR | 10-2018-0043526 | A | | 4/2018 |

OTHER PUBLICATIONS

English translation, Shoji, JP S6028387 U, Feb. 1985 (Year: 1985).*

* cited by examiner

DRYER STAND

CROSS-REFERENCE TO RELATED APPLICATION

This application claims the priority benefit of U.S. Provisional Application No. 62/733,478, filed on Sep. 19, 2018, and Korean Patent Application No. 10-2019-0070283, filed on Jun. 13, 2019, the entire disclosures of all of which are hereby expressly incorporated by reference into the present application.

BACKGROUND OF THE DISCLOSURE

Field of the Disclosure

The present disclosure relates to a dryer stand in which a dryer for discharging drying air may be mounted. More particularly, the present disclosure relates to a dryer stand which can purify indoor air through a built-in air purifier.

Description of the Related Art

When using a dryer to dry the human body, a user typically moves the dryer toward a portion of the human body to perform drying while holding the dryer.

In order to solve an inconvenience that a user must hold the dryer to perform drying while holding the dryer, a stand which can mount a dryer has been proposed, such as KR 2015-0031643 A.

However, even though the dryer is mounted, the stand of the related art does not have a function of purifying indoor air, while interest in such a function has recently increased. Accordingly, the consumer has an inconvenience in that an air purifier is provided separate from the stand.

In this regard, KR 2006-0019298 A discloses a dryer provided with an air purification filter, which helps to purify the drying air discharged from the dryer, but this dryer has a limit in purifying indoor air.

Furthermore, the stand according to the related art does not propose a method to optimize the flow path of air passing through the air purifier.

SUMMARY OF THE DISCLOSURE

The present disclosure has been made in view of the above problems, and provides a dryer stand that allows a user to dry a drying target without holding the dryer.

The present disclosure further provides a dryer stand that can purify indoor air separately from the mounting of the dryer.

The present disclosure further provides a dryer stand that can increase the air purification rate by optimizing the flow path of air passing through the air purifier.

In accordance with an aspect of the present disclosure, a dryer stand includes: a base which is disposed in a lower side; a receptacle in which a dryer for discharging drying air is mounted; a body which is disposed above the base and accommodates the receptacle therein at a certain height in an upward direction from the base; a fan which is accommodated in the body and cause a flow of air that is introduced into the body and discharged to the outside; and an air purifier which is disposed in a flow path of air flown by the fan.

In this case, the base is provided with a suction hole through which air sucked into the body by the fan passes, so that air to be purified may be introduced into the stand.

The fan flows air from a lower side toward an upper side, and the air purifier is a plurality of air purifiers that are respectively spaced apart from each other at a certain interval from a lower side toward an upper side.

In this case, a discharge hole through which air discharged to the outside of the body by the fan passes is formed in the side body.

Alternatively, a discharge hole through which air discharged to the outside of the body by the fan passes is formed between the upper body and the receptacle.

Unlike this, the fan flows air from one of a left side and a right side to the other, and the air purifier is a plurality of air purifiers that are respectively spaced apart from each other at a certain interval from a left side toward a right side.

In this case, a discharge hole through which air discharged to the outside of the body by the fan passes is formed in the side body.

Unlike this, a suction hole through which air sucked into the body by the fan passes is formed in the body.

In this case, a discharge hole through which air discharged to the outside of the body by the fan passes is formed in the body.

Alternatively, a discharge hole through which air discharged to the outside of the body by the fan passes is formed between the body and the receptacle.

BRIEF DESCRIPTION OF THE DRAWINGS

The above and other objects, features and advantages of the present disclosure will be more apparent from the following detailed description in conjunction with the accompanying drawings, in which.

DESCRIPTION OF EXEMPLARY EMBODIMENTS

Exemplary embodiments of the present disclosure are described with reference to the accompanying drawings in detail. The same reference numbers are used throughout the drawings to refer to the same or like parts. Detailed descriptions of well-known functions and structures incorporated herein may be omitted to avoid obscuring the subject matter of the present disclosure.

Figure 1:
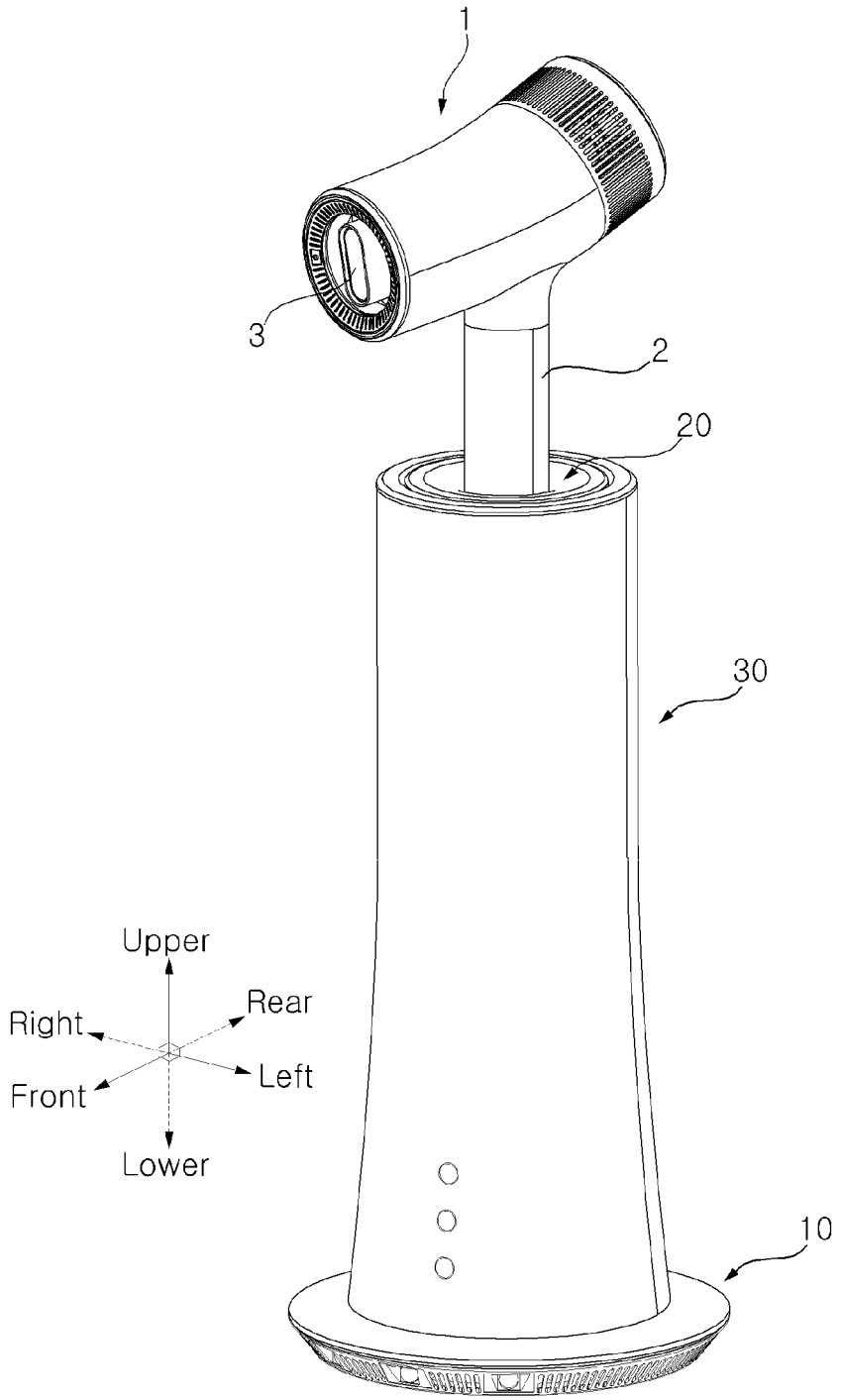
FIG. 1 is a perspective view of a state in which a dryer is mounted in a dryer stand according to an embodiment of the present disclosure.

The present disclosure can be described with a three-dimensional coordinate system in which each side shown in FIG. 1 is named front, rear, upper, lower, left, and right.

The present disclosure may be described with reference to a spatial orthogonal coordinate system based on X, Y and Z axes that are orthogonal to each other shown in FIG. 2, and the like. In the present specification, the X-axis, the Y-axis, and the Z-axis are defined by setting the vertical direction as the Z-axis direction, and setting the front-rear direction as the X-axis direction. Each axis direction (X-axis direction, Y-axis direction, Z-axis direction) means the both directions in which each axis extends. The symbol "+" in front of each axis direction (+X-axis direction, +Y-axis direction, +Z-axis direction) means a positive direction which is one of the both directions in which each axis extends. The sign "−" in front of each axis direction (−X-axis direction, −Y-axis direction, −Z-axis direction) means a negative direction which is one of the both directions in which each axis extends.

Hereinafter, a dryer stand according to an embodiment of the present disclosure will be described with reference to FIGS. 1 to 6.

Figure 2:
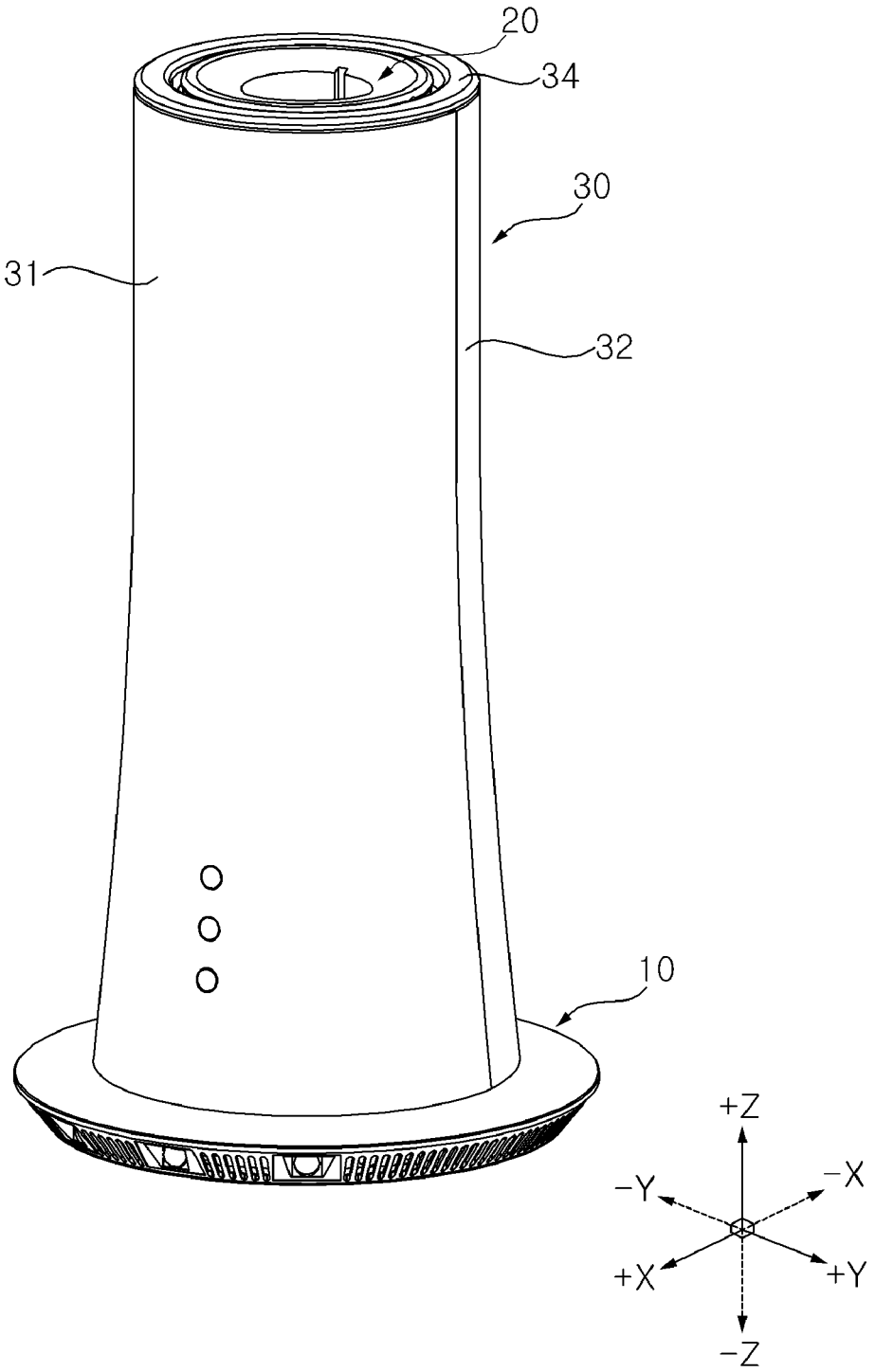
FIG. 2 is a perspective view of a state in which a dryer is not mounted in a dryer stand according to an embodiment of the present disclosure.
Figure 3:
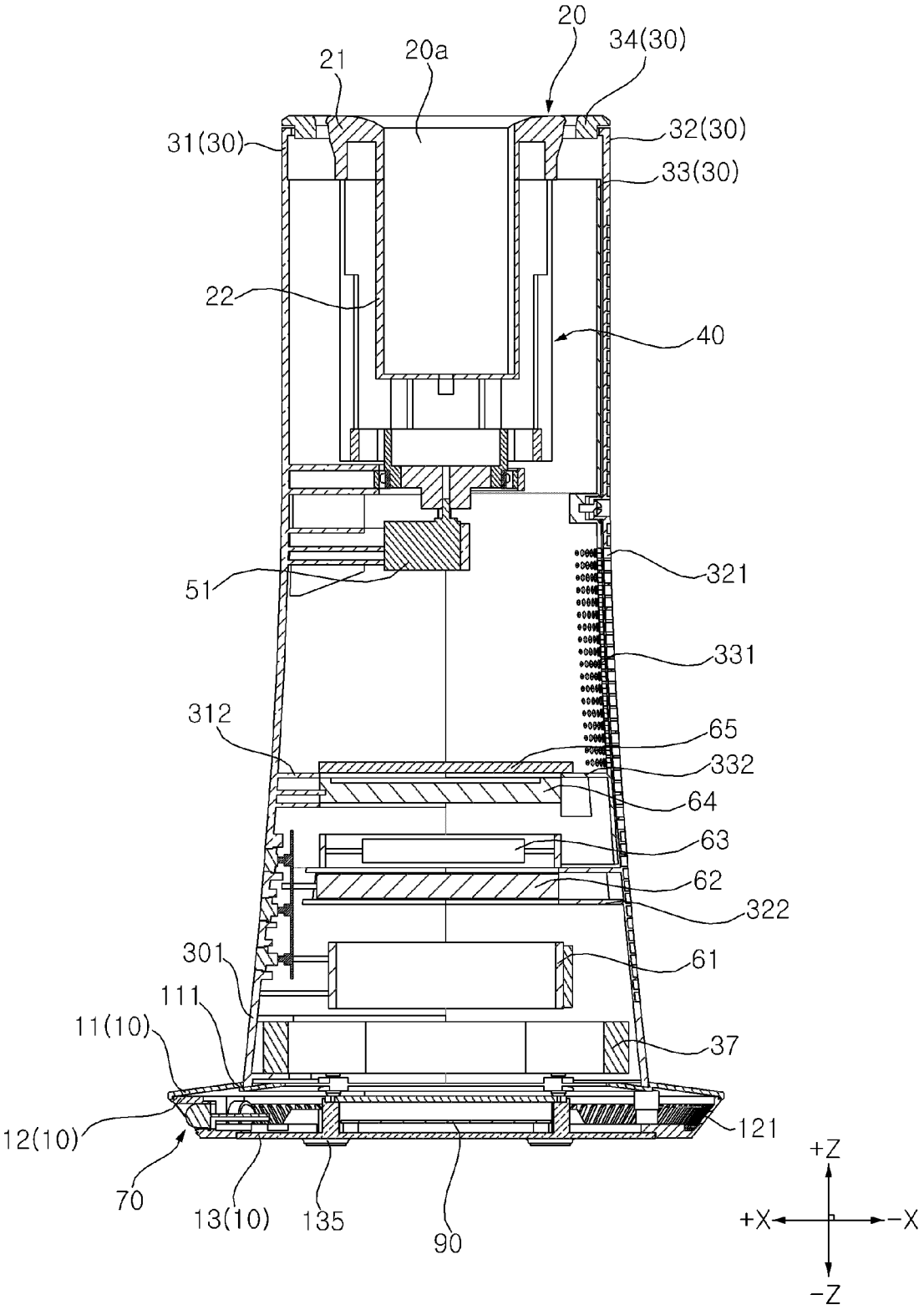
FIG. 3 is a longitudinal cross-sectional view of a dryer stand according to an embodiment of the present disclosure from the left.
Figure 4:
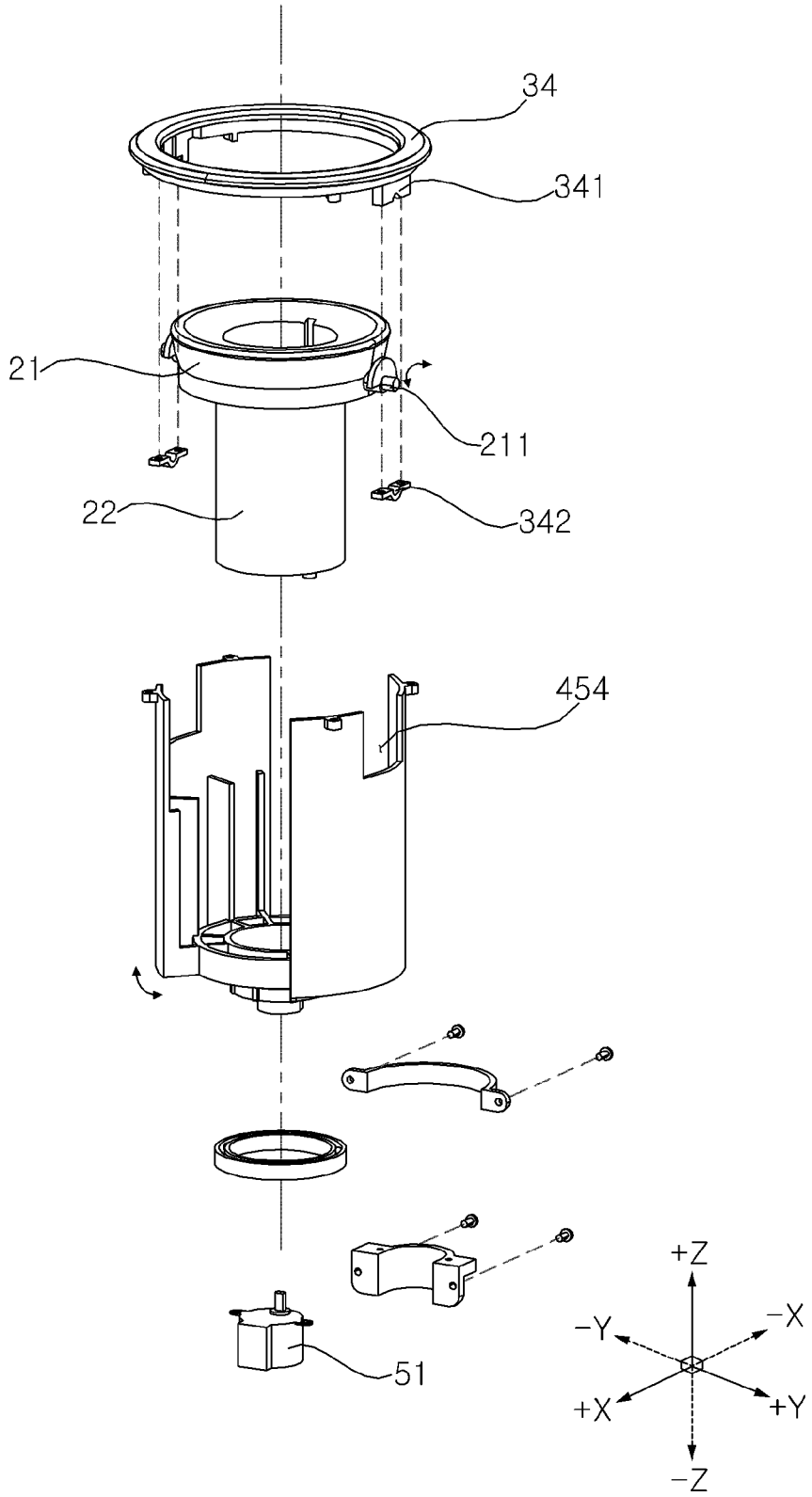
FIG. 4 is an exploded perspective view of an upper portion of a dryer stand according to an embodiment of the present disclosure.
Figure 5:
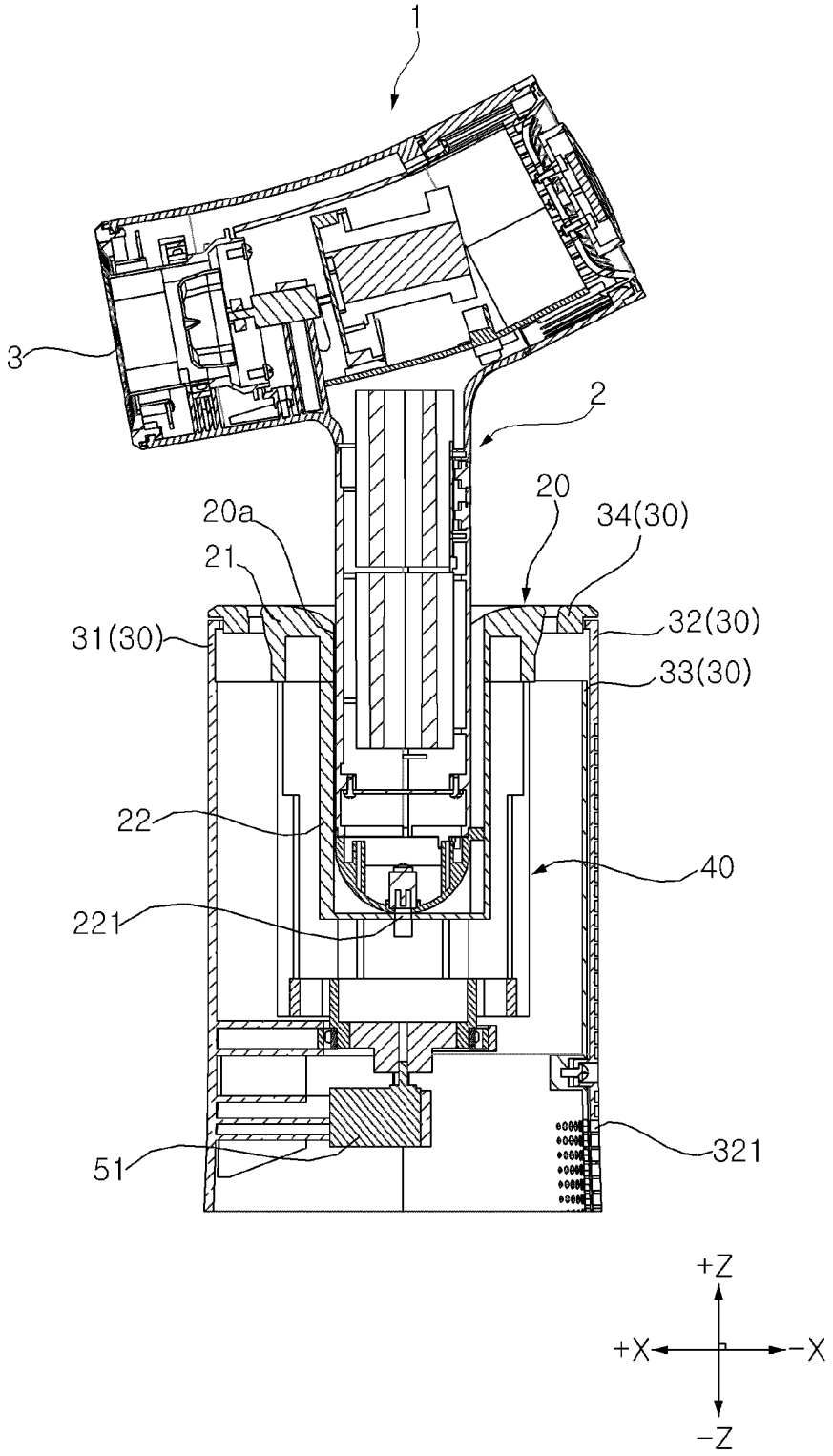
FIG. 5 is a cross-sectional view of an upper portion showing a state in which a dryer is mounted in a dryer stand according to an embodiment of the present disclosure.
Figure 6:
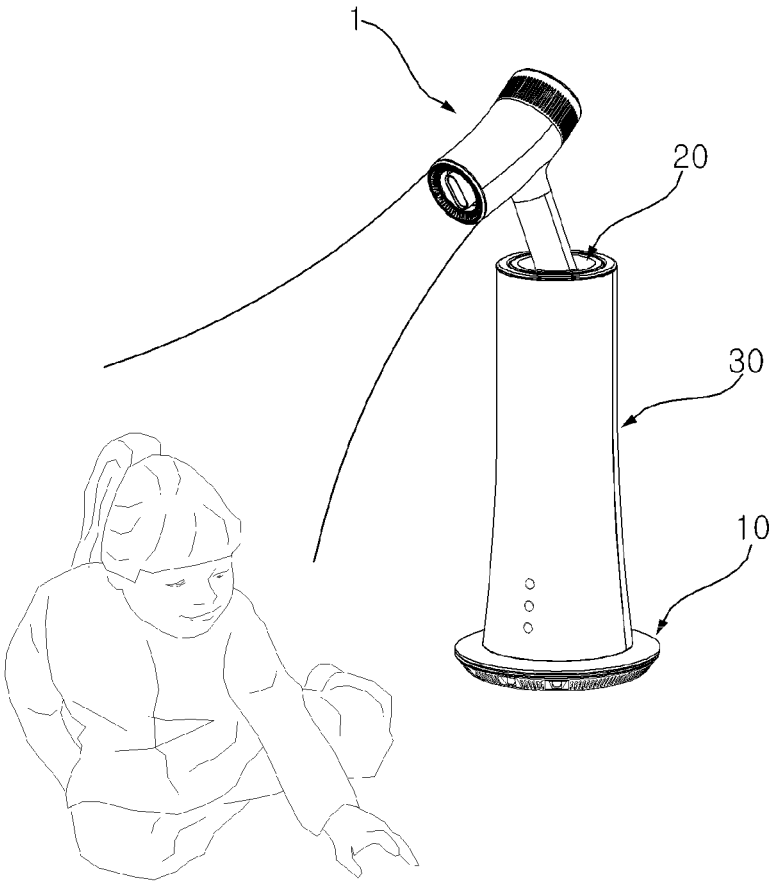
FIG. 6 is a use state diagram in a dryer stand according to an embodiment of the present disclosure.

FIG. 1 is a perspective view of a state in which a dryer is mounted in a dryer stand according to an embodiment of the present disclosure, FIG. 2 is a perspective view of a state in which a dryer is not mounted in a dryer stand according to an embodiment of the present disclosure, FIG. 3 is a longitudinal cross-sectional view of a dryer stand according to an embodiment of the present disclosure from the left, FIG. 4 is an exploded perspective view of an upper portion of a dryer stand according to an embodiment of the present disclosure, FIG. 5 is a cross-sectional view of an upper portion showing a state in which a dryer is mounted in a dryer stand according to an embodiment of the present disclosure, and FIG. 6 is a use state diagram in a dryer stand according to an embodiment of the present disclosure.

In the dryer stand (hereinafter, simply, referred to as 'stand') according to an embodiment of the present disclosure, as shown in FIG. 1, a dryer 1 for discharging drying air may be mounted so that a user may perform drying of a drying target without gripping the dryer.

Here, the dryer 1 is an apparatus which performs drying with respect to a drying target, such as a person or a companion animal, by using drying air discharged through a discharge port 3. In addition, as shown in FIG. 5, a rechargeable battery may be built-in the dryer 1, so that user may carry the dryer and perform drying of a drying target.

As shown in FIGS. 1 and 2, the stand according to an embodiment of the present disclosure may include a base 10 which is disposed in a lower side and serves as a pedestal, a receptacle 20 in which the dryer 1 is mounted, and a body 30 which is disposed above the base 10 and accommodates the receptacle 20 therein at a certain height in an upward direction from the base 10. For example, the body 30 may have a first end connected to the base 10 and a second end space upward from the base 10. The dryer 1 may be detachably mounted in the receptacle 20.

As shown in FIG. 2, the body 30 may include an upper body 34 disposed adjacent to an upper side of the receptacle 20, and a side body 31, 32 disposed between the upper body 34 and the base 10. That is, the upper body 34 may be disposed at the second end of the body 30. The side body 31, 32 may form a side shape of the stand, and may include a front body 31 disposed at the front side and a rear body 32 disposed at the rear side.

As shown in FIGS. 1 to 3, the front body 31 and the rear body 32 may be detachably coupled to each other by a plurality of fastening members (not shown). As a fastening method of the front body 31 and the rear body 32 using the fastening member, a screw fastening method, a snap fit fastening method using a snap protrusion-groove, and/or a welding method may be used.

As described above, because the side body 31, 32 includes the front body 31 and the rear body 32, if it is desired to access the inside of the stand, removing only one of the front body 31 and the rear body 32 is necessary, so that repair, replacement, and the like of the internal components of the stand can be easily achieved.

However, in some embodiments, the front body 31 and the rear body 32 may be integrally formed to form a side body as a single member.

As shown in FIGS. 3 and 4, a lower end 301 of the side body 31, 32 may be fitted into a furrow 111 formed in at least a part of an upper end of the base 10. As an example, such a furrow 111 may be formed in a ring shape. The body 30, in particular, the side body 31, 32 may accommodate the receptacle 20 therein. In addition, various components, such as a rotation motor, a power transmission mechanism, a fan, an air purifier, which will be described later, may be accommodated inside the body 30 and may be detachably coupled to the body 30.

That is, the side body 31, 32 may serve as a support or a stem. However, in some embodiments, a stem may be provided separately from the body 30 so the body 30 is not limited to a stem.

Figure 8:
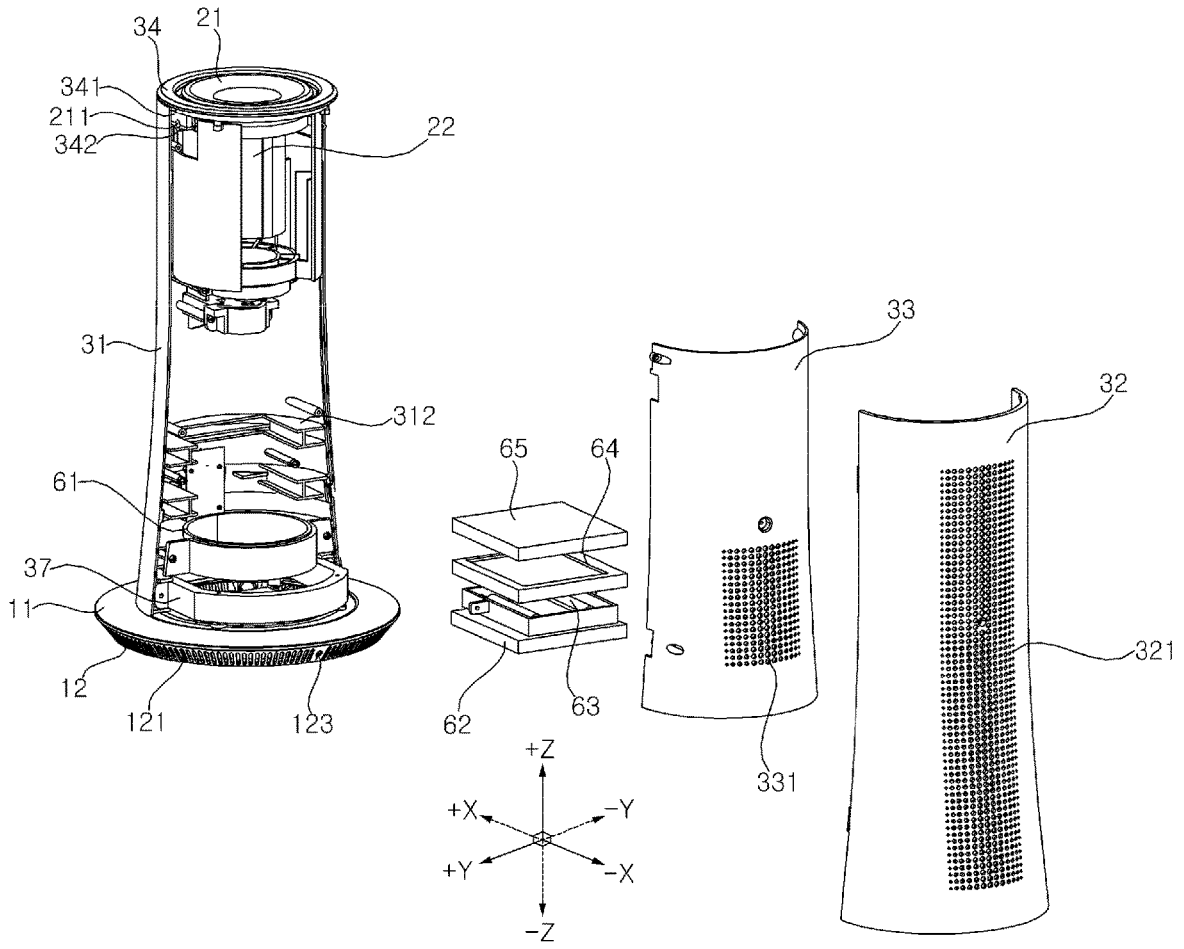
FIG. 8 is a rear exploded perspective view of a dryer stand according to an embodiment of the present disclosure.
Figure 10A:
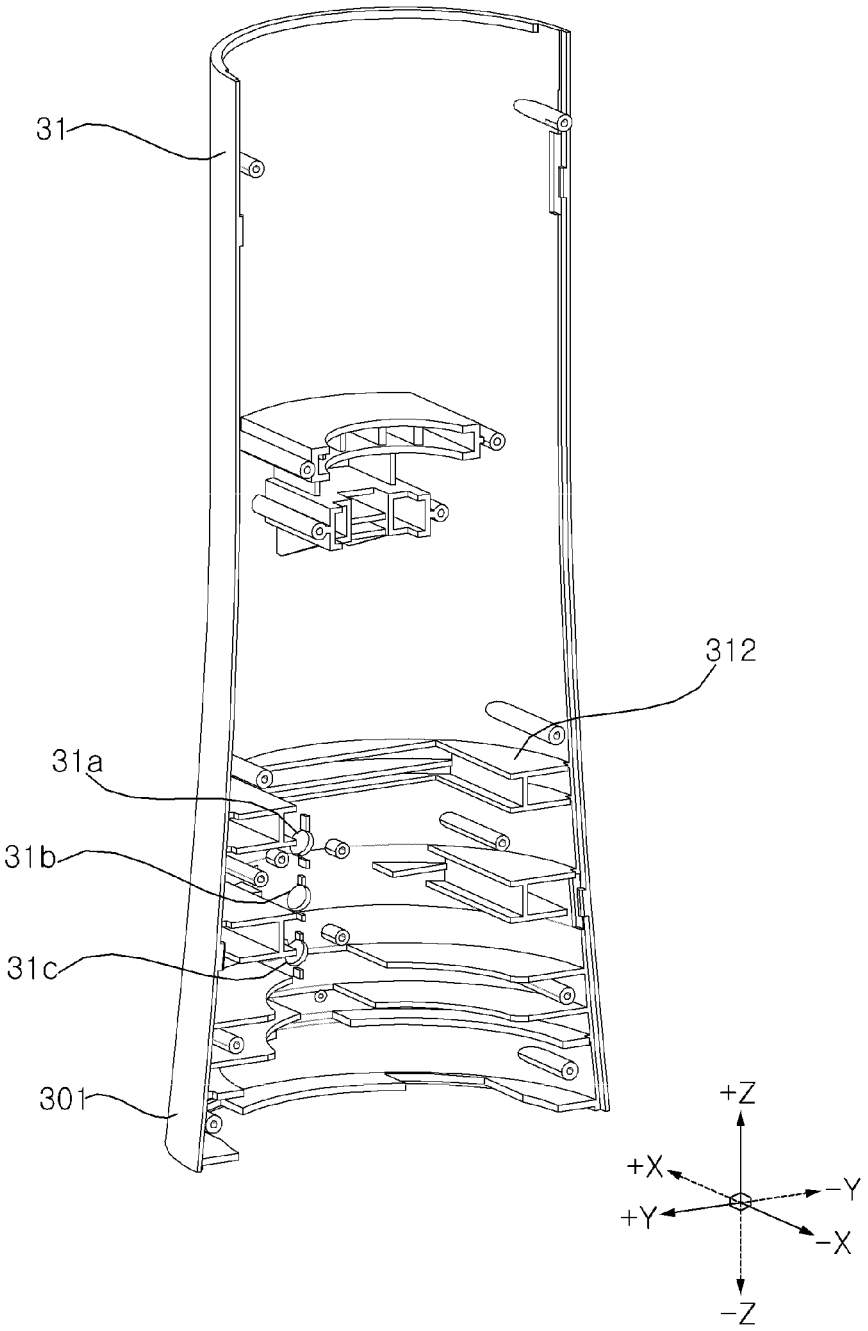
FIG. 10A is a perspective view of a front body of a dryer stand according to an embodiment of the present disclosure.
Figure 10B:
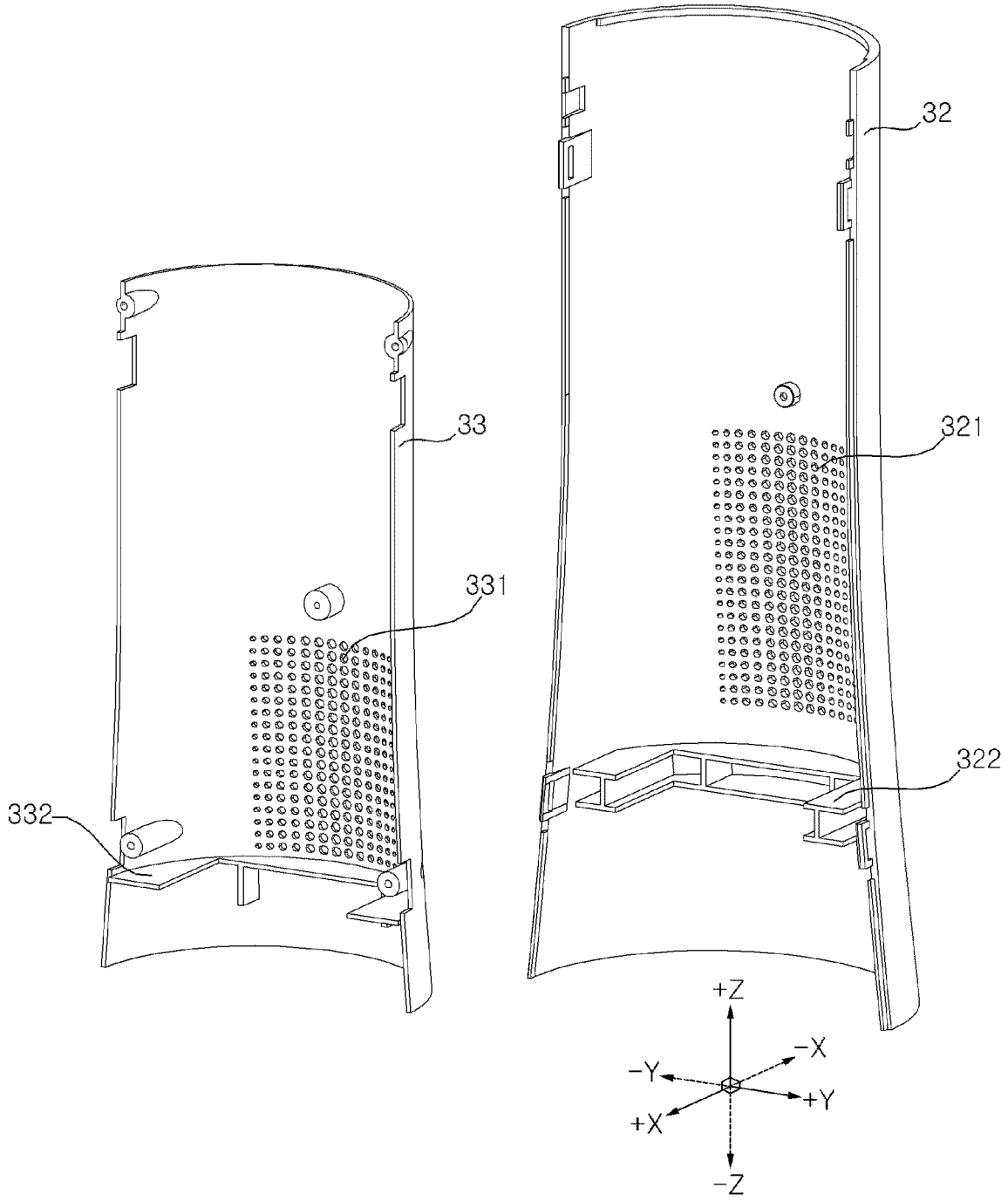
FIG. 10B is a perspective view of a rear body and an inner body of a dryer stand according to an embodiment of the present disclosure.

In addition, as shown in FIGS. 8 and 10B, the body 30 may further include an inner body 33, and the inner body 33 may be coupled to the inner surface of the rear body 32. The inner body 33 may be detachably coupled to the rear body 32 by a screw fastening method, a snap fit fastening method using a snap protrusion-groove, and/or a welding method.

When the inner body 33 is provided, the rear body 32 may be removed from the stand to access the air purifier which requires periodic replacement and management. It may not be necessary to remove the rear body 32 and the inner body 33 to access the rotation motor 51, the power transmission mechanism 40, and the receptacle 20, depending on the configuration of the stand.

As shown in FIGS. 3 and 6, the receptacle 20 is not limited to simply mounting the dryer 1, but may also be implemented to accomplish at least one of a tilting operation in a front-rear direction and a rotation operation in the left-right direction about an axis of the body 30. Thus, the air discharge direction of the dryer 1 may be shifted simultaneously or separately toward the front-rear direction and the left-right direction according to the position and size of a drying target.

In this case, the tilting operation refers to rotation of the receptacle 20 (and a dryer, if mounted therein) in the front-rear direction, that is, the rotation about the Y axis.

Rotation in the left-right direction means the rotation about the Z axis, which may also be an axis of the body 30. However, an axis which becomes the center of the tilting operation in response to the rotation in the left-right directions of the receptacle 20 may be changed to any one axis on the XY plane.

As shown in FIGS. 3 to 5, the receptacle 20 includes a tub 21, 22 that forms a groove 20*a* into which at least some portion of a grip 2 of the dryer 1 is inserted, and the tubs 21 and 22 may include an upper tub 21 and a lower tub 22.

As shown in FIGS. 3 to 5, the stand according to the embodiment of the present disclosure is a configuration for the tilting operation of the receptacle 20. The stand may include a tilting pin 211 and a pin mount 341, 342.

The tilting pin 211 may extend toward the outside from the outer surface of the receptacle 20 so that it may become a center of the tilting operation of the receptacle 20. As an example, the tilting pin 211 may be integrally formed on the outer surface of the upper tub 21.

One side of the pin mounts 341 and 342 may be coupled to the upper body 34, and an insertion hole into which the tilting pin 211 is inserted may be formed so that the tilting pin 211 may be rotatably supported.

The receptacle 20 according to the embodiment of the present disclosure may be rotated in the front-rear direction (i.e., rotated about the Y axis) while the tilting pin 211 is inserted into the insertion hole formed in the pin mount 341, 342, so that the tilting operation can be performed.

As a result, as shown in FIG. 6, the air discharge direction of the dryer 1 mounted in the receptacle 20 may be shifted in the front-rear direction.

As shown in FIGS. 3 to 5, the stand according to the embodiment of the present disclosure is a configuration for rotating operation in the left-right direction of the receptacle 20, and may include a rotation motor 51 and a power transmission mechanism 40.

In this case, the receptacle 20 may be rotated in the left-right direction according to the rotation of the rotation motor 51 in the forward and reverse direction. The power transmission mechanism 40 may control the transmission of the power of the rotation motor 51 to the receptacle 20.

The receptacle 20 is coupled to the upper body 34 through the tilting pin 211 and the pin mount 341, 342, and the power transmission mechanism 40 is coupled to the upper body 34, so that the receptacle 20 may be coupled to the power transmission mechanism 40 via the upper body 34. In this case, the upper body 34 may be rotatably supported by the side body 31, 32. Thus, the power of the rotation motor 51 may be transmitted to the receptacle 20 through the power transmission mechanism 40 and the upper body 34, so that the receptacle 20 can be rotated in the left-right direction according to the rotation of the rotation motor 51 in the forward and reverse direction.

As a result, as shown in FIG. 6, the air discharge direction of the dryer 1 mounted in the receptacle 20 may be shifted in the left-right direction.

As shown in FIG. 4, the power transmission mechanism 40 may have a space, corresponding to the trajectory of the tilting operation of the receptacle 20, partitioned inside thereof, and may have a certain space 454, corresponding to a space where the tilting pin 211 and the pin mount 341 and 342 are disposed, formed at one side thereof.

Thus, the tilting operation in the front-rear direction and the rotation operation in the left-right direction may be independently performed. As a result, the air discharge direction of the dryer 1 mounted in the receptacle 20 may be shifted simultaneously or separately in the front-rear direction and the left-right direction.

The present disclosure not limited to rotating the receptacle 20 mounting the dryer 1, but is devised to provide a stand for purifying indoor air by removing odors such as companion animal odor or human odor, and removing harmful substances suspended in the air. To this end, as shown in FIG. 3, the stand may be provided with an air purifier, and a detailed description thereof will be described below.

Hereinafter, with reference to FIGS. 1 to 14, a configuration for purifying indoor air among the configurations of a stand according to an embodiment of the present disclosure and a configuration related thereto will be described in detail.

Figure 7:
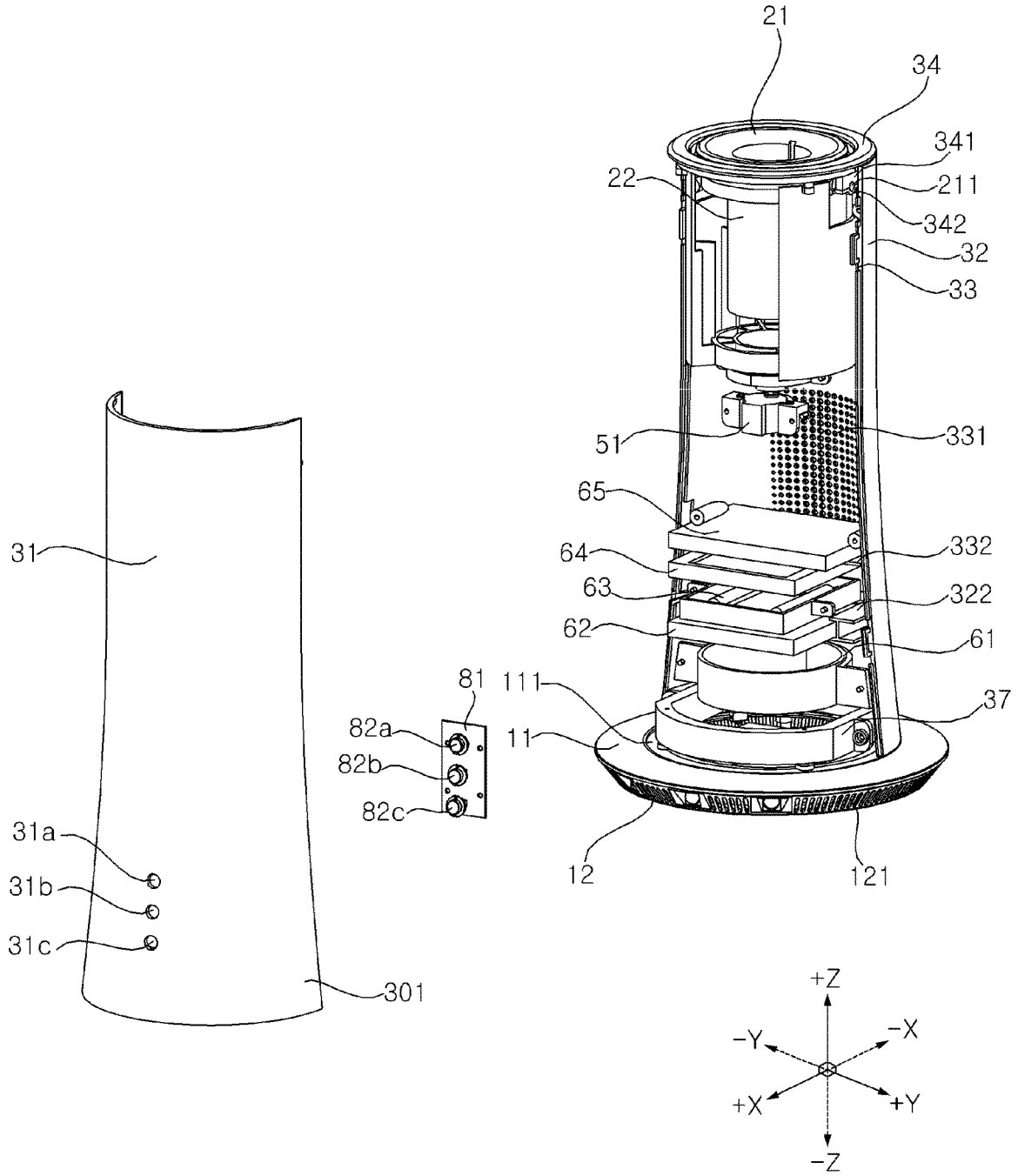
FIG. 7 is a front exploded perspective view of a dryer stand according to an embodiment of the present disclosure.
Figure 9:
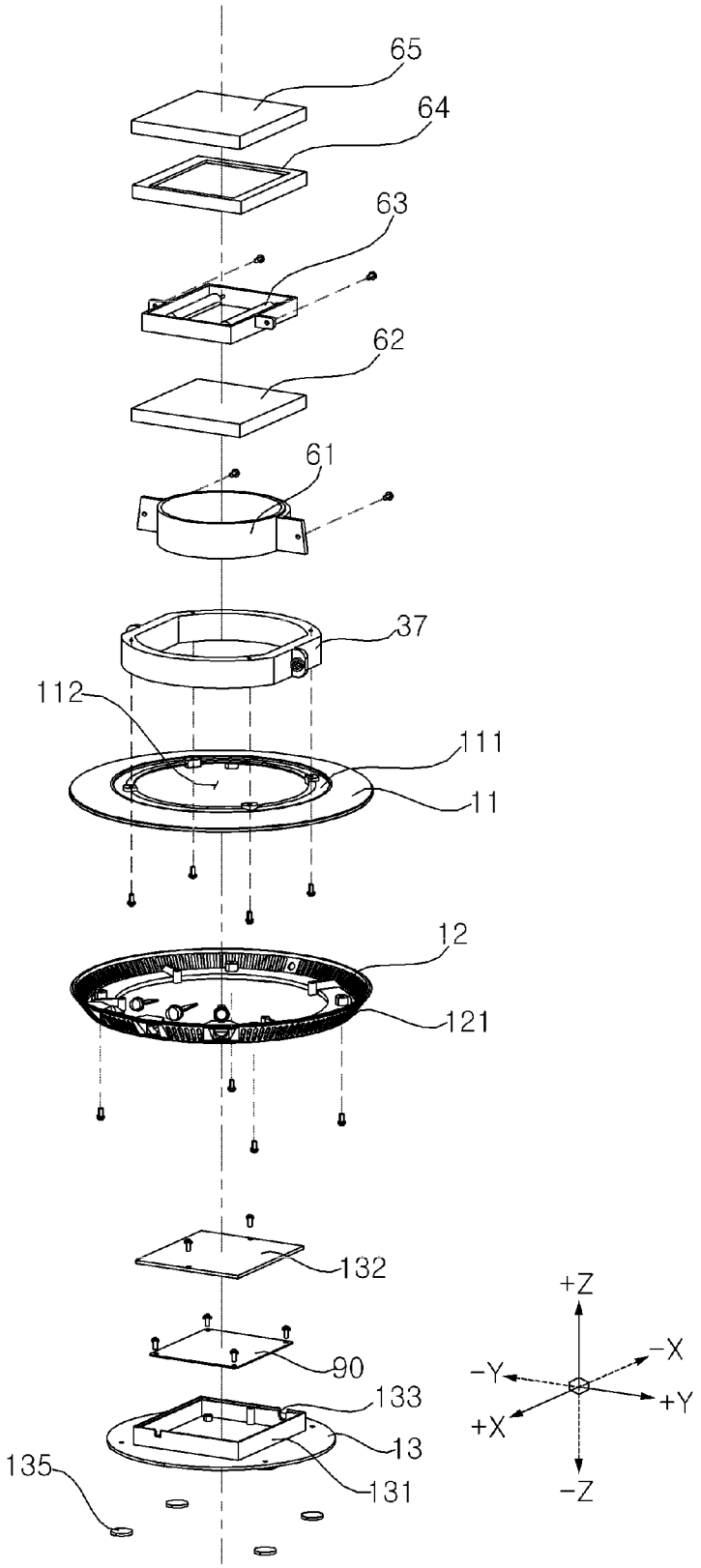
FIG. 9 is an exploded perspective view of the lower part of a dryer stand according to an embodiment of the present disclosure.
Figure 11:
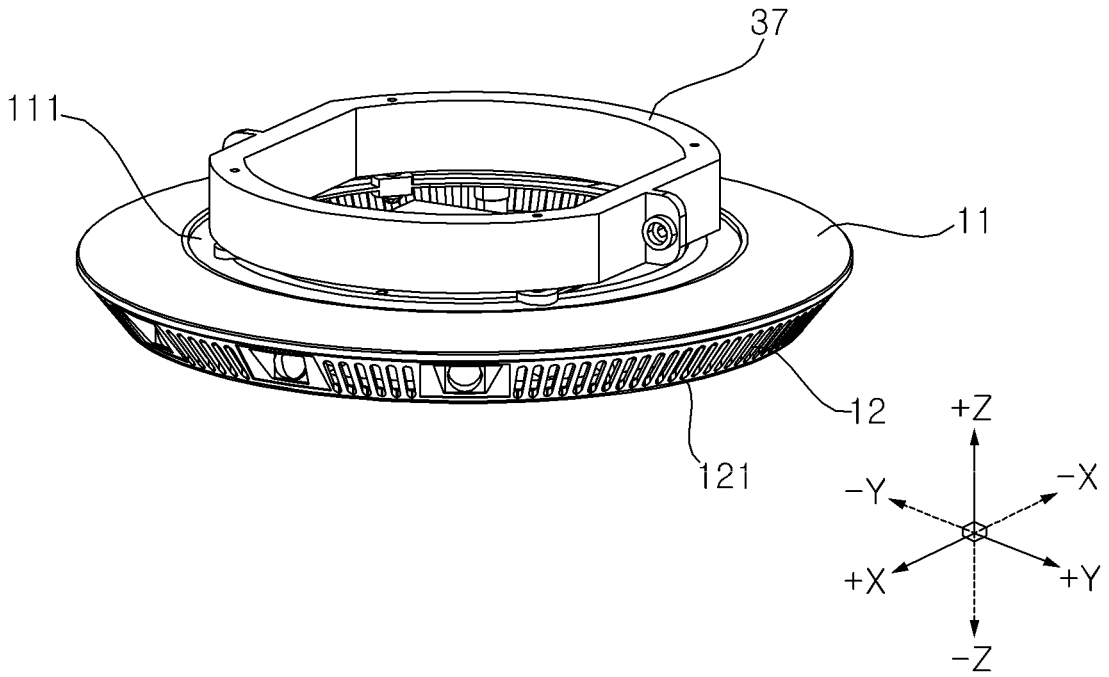
FIG. 11 is a perspective view of a base and a supporter of a dryer stand according to an embodiment of the present disclosure.
Figure 13:
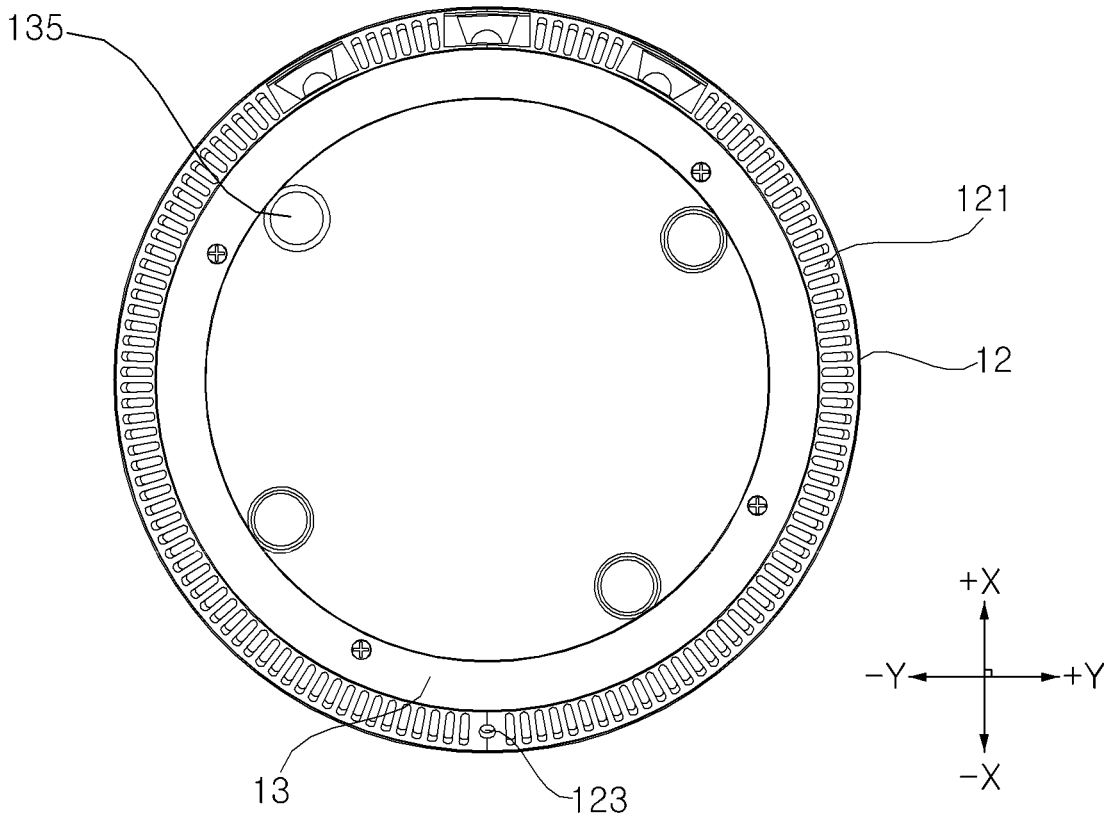
FIG. 13 is a bottom view of a dryer stand according to an embodiment of the present disclosure.
Figure 14:
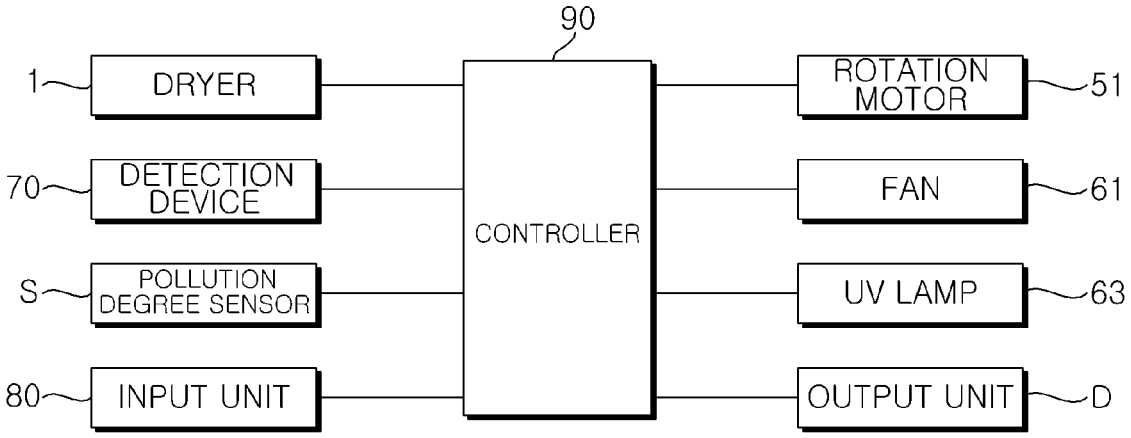
FIG. 14 is a control system diagram of a dryer stand according to an embodiment of the present disclosure.

FIG. 7 is a front exploded perspective view of a dryer stand according to an embodiment of the present disclosure, FIG. 8 is a rear exploded perspective view of a dryer stand according to an embodiment of the present disclosure, FIG. 9 is an exploded perspective view of the lower part of a dryer stand according to an embodiment of the present disclosure. FIG. 10A is a perspective view of a front body of a dryer stand according to an embodiment of the present disclosure, FIG. 10B is a perspective view of a rear body and an inner body of a dryer stand according to an embodiment of the present disclosure, FIG. 11 is a perspective view of a base and a supporter of a dryer stand according to an embodiment of the present disclosure, FIGS. 12A to 12F are views schematically illustrating an air flow path of a dryer stand according to various embodiments of the present disclosure, FIG. 13 is a bottom view of a dryer stand according to an embodiment of the present disclosure, and FIG. 14 is a control system diagram of a dryer stand according to an embodiment of the present disclosure.

As shown in FIGS. 7 to 9, the stand according to an embodiment of the present disclosure may include the base 10, the receptacle 20, the body 30, a fan 61, and the air purifier. The fan 61 may cause a flow of air to be introduced into the body 30 and then discharged outside the body 30. The fan 61 may be provided with various means and configurations that can cause the above mentioned flow of air, such as a centrifugal, a four-flow, and an axial fan.

The fan 61 may flow air from the lower side toward the upper side.

The air purifier may be disposed so as to be spaced apart from the fan 61 by a certain distance toward the upper side of the body 30. The air purifier may be provided as a plurality of air purifiers including a HEPA filter 62, an ultraviolet generator 63, a photocatalyst filter 64, a carbon filter 65, and, in some arrangements, the fan 61.

Meanwhile, in FIGS. 7 to 9, the HEPA filter 62, the ultraviolet generator 63, the photocatalyst filter 64, and the carbon filter 65 may be sequentially disposed from the lower side toward the upper side, but they are not limited to such a disposition order.

That is, in addition to the embodiment having all of the HEPA filter 62, the ultraviolet generator 63, the photocatalyst filter 64, and the carbon filter 65, it should be noted that a combination of some of them or an embodiment having other filters such as antibacterial filter, a deodorizing filter may also be provided.

The HEPA filter 62 is an air filter, and is a filter that can remove fine particles such as dust, mite carcasses, pollen, tobacco smoke (particles), floating fungi, animal hair, and the like as well as fine dust floating with air.

The ultraviolet generator 63 may be constituted of an ultraviolet light emitting diode (UV LED) or an ultraviolet (UV) lamp. The ultraviolet generator 63 may sterilize bacteria or microorganisms suspended in the air by irradiating ultraviolet light.

The photocatalyst filter 64 may decompose harmful substances by a photochemical reaction to perform an odor removing function (that is, a deodorizing function) of a companion animal or human. The photocatalyst filter 64 may be formed of a breathable adsorption base material for adsorbing harmful substances in the air, a photocatalyst attached to the breathable adsorption base material, and a cocatalyst for activating the photocatalyst.

The ultraviolet generator 63 may serve as a light source for activating the photocatalyst provided in the photocatalyst filter 64. Alternatively, in some embodiments, a light emitting module for activating the photocatalyst may be provided separately from the ultraviolet generator 63.

The carbon filter 65 is a filter that can remove odors and harmful gases contained in the air through a chemical adsorption method using activated carbon.

As shown in FIG. 7 and FIG. 8, the inflow of air by the fan 61 may be accomplished through a suction hole 121 formed in the side surface of the base 10, and the discharge of air may be accomplished by the fan 61 through a discharge hole 321 formed in the rear body 32.

The HEPA filter 62, the ultraviolet generator 63, the photocatalyst filter 64, and the carbon filter 65 may be disposed on a flow path of air introduced into the suction hole 121 by the fan 61 and discharged to the discharge hole 321. Thus, the air may be discharged to the outside of the body 30 while various harmful substances, odors, and the like contained in the air introduced into the body 30 are removed.

As shown in FIGS. 7 to 9 and 11, the base 10 may include an upper base 11, a middle base 12, and a lower base 13. The upper base 11 may be provided with the body 30 installed at the upper side. As shown in FIG. 7 and FIG. 11, a lower end portion 301 of the side body 31, 32 may be fitted into the furrow 111 formed in at least part of an upper end portion of the upper base 10.

The middle base 12 may be coupled to the lower side of the upper base 11, and the lower base 13 may be coupled to the lower side of the middle base 12. As an example, as shown in FIG. 9, the upper base 11, the middle base 12, and the lower base 13 may be coupled to each other by screws.

In the middle base 12, a suction hole 121 through which air sucked into the body 30 by the fan 61 may be provided. In this arrangement, the suction hole 121 may be a plurality of suction holes that are formed in the side surface of the middle base 12, and the suction holes 121 may be spaced apart from each other at predetermined intervals. Thus, in comparison with the arrangement where the suction hole 121 is formed as a single hole having a relatively large diameter, it is possible to prevent foreign substances such as hair of a companion animal and dust from being sucked into the body 30.

As shown in FIGS. 7, 8 and 11, the middle base 12 may be formed inclined toward the inner side as it progresses from the upper end to the lower end. That is, the side surface of the middle base may be inclined inward as it extends from the lower side of the upper base 11 to the lower base 13. Thus, liquid, such as water falling toward the floor (e.g., water falling toward the floor from the hair of drying target) can be prevented from flowing into the stand through the suction hole 121.

In addition, according to the embodiment, the stand may further include a filter that is installed in the inner surface of the middle base 12 to filter the foreign matter in the flow of air introduced through the suction hole 121.

Figure 12A:
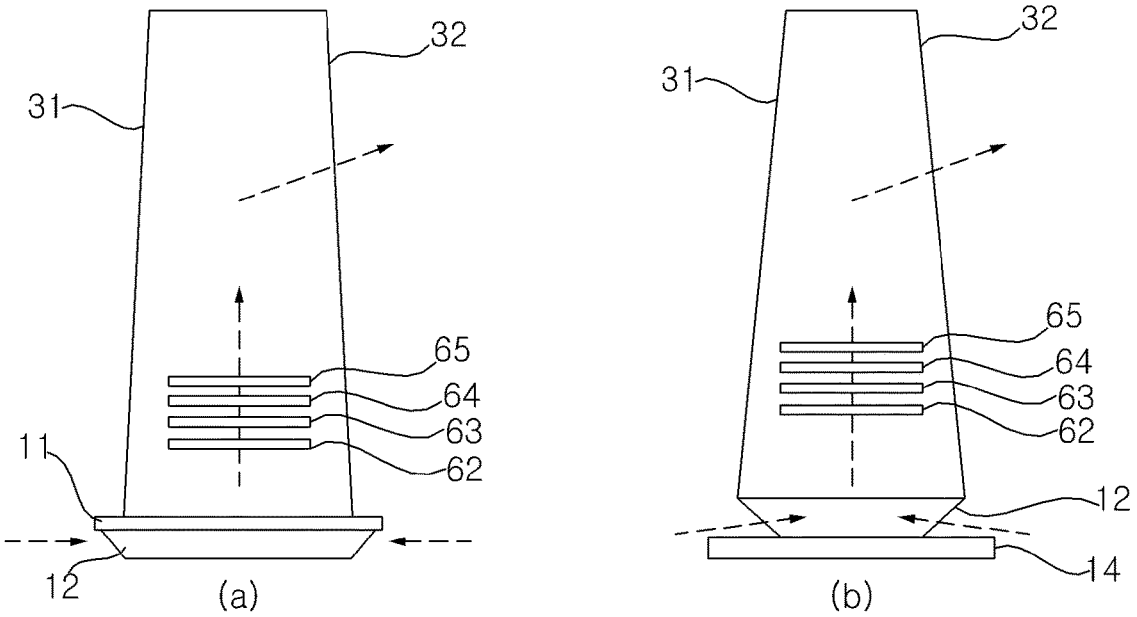
FIGS. 12A to 12F are views schematically illustrating an air flow path of a dryer stand according to various embodiments of the present disclosure.

As shown in (b) of FIG. 12A, the base 10 may further include a base plate 14 that is coupled to the lower side of the lower base 13, and is formed to have a width greater than the width of the upper base 11, the middle base 12, the lower base 13, and the body 30. The base plate 14 may serve as a pedestal to more firmly mount the stand on the ground or other surface.

As shown in FIG. 9, a controller 90 for controlling the operation of the fan 61 and the air purifier may be installed on the lower base 13. The controller 90 may be accommodated inside a control box 131, 132 installed on the lower base 13. In one side of the control box 131, 132, a hole 133 is provided through which a cable for supplying power to the controller 90 and other components that require power may pass.

The controller 90 may be disposed on a flow path of air passing through the suction hole 121, and thus heat generated in the controller 90 may be effectively removed.

As shown in FIGS. 7 and 10B, the side body 31, 32 may be provided with a discharge hole 321 through which the air discharged to the outside of the body 30 by the fan 61 passes. For example, the discharge hole 321 may be formed in the rear body 32. In this arrangement, the discharge hole 321 may be a plurality of discharge holes that are formed in the side surface of the rear body 32 and are spaced apart from each other by a predetermined interval. Thus, in comparison with the arrangement where the discharge hole 321 is formed of a single hole having a relatively large diameter, the discharge noise of the air can be reduced, and the air volume can be prevented from being concentrated on a certain point behind the stand.

In addition, as shown in FIGS. 8 and 10B, when the body 30 further includes the above inner body 33, the inner body 33 may have a discharge hole 331 through which the air discharged to the outside of the body 30 by the fan 61 also passes. Thus, the air purified by passing through the air purifier by the fan 61 may be discharged to the outside through the discharge hole 331 of the inner body 33 and the discharge hole 321 of the rear body 32 sequentially.

As shown in FIGS. 7, 8, 10A, and 10B, the air purifier configured as described above may be detachably coupled to the side body 31, 32. To this end, the side body 31, 32 may have guide ribs 312, 322 extending from the inner side surface toward the interior of the body to support the air purifier. The guide rib 312, 322 may be formed in a shape corresponding to at least a part of an outer surface of the air purifier and may be in surface contact with the air purifier to support the air purifier. In addition, as shown in FIGS. 8 and 10B, when the body 30 further includes the inner body 33, a guide rib 332 may be formed on an inner surface of the inner body 33 to support the air purifier. That is, the air purifier may be seated and coupled to a plurality of guide ribs 312 formed in the inner surface of the front body 31, a plurality of guide ribs 322 formed in the inner surface of the rear body 32, and the guide rib 332 formed in the inner surface of the inner body 33 to be fixed in a preset position. Such guide ribs 312, 322, 332 may guide the coupling of the air purifier to the body 30, and may easily allow separation of the air purifier from the body 30 when replacement and repair are needed.

Furthermore, according to the embodiment, the air purifier may include a separate fastening member (e.g., screwing member) for coupling to the side body 31, 32 and/or the inner body 33, in addition to the guide rib 312, 322, 332.

As shown in FIG. 11, the stand according to an embodiment of the present disclosure may further include a supporter 37 in the lower side in order to prevent the risk of overturning of the stand due to collision with the infant or companion animal. The supporter 37 may be provided in the upper side of the base 10, and at least a part of the outer surface is in close contact with the inner surface of the side body 31, 32, so that not only the function of preventing the above mentioned overturning but also the coupling to the base 10 of the side body 31, 32 can be more firmly achieved.

As described above, the stand according to the embodiment of the present disclosure may include the controller 90. The controller 90 may be implemented by using at least one of application specific integrated circuits (ASICs), digital signal processors (DSPs), digital signal processing devices (DSPDs), programmable logic devices (PLDs), field programmable gate arrays (FPGAs), processors, controllers, micro-controllers, microprocessors, and electrical units for performing other functions.

As shown in FIG. 14, the controller 90 may control the operation of the rotation motor 51. The controller 90 may automatically control the rotation operation of the receptacle 20 in the left-right direction by adjusting the rotation direction and the rotation angle of the rotation motor 51 based on the information on the drying target (e.g., information on the position and size of the drying target) detected by a detection device 70. Here, the detection device 70, as shown in FIG. 8, may be accommodated in the base 10 and may detect the position and size of the drying target, such as infant or companion animal, adjacent to the stand and, for example, may be an infrared sensor.

As shown in FIG. 14, the controller 90 may receive information on pollution degree of the ambient air from a pollution degree sensor S provided in the stand, and may control whether the fan 61 and/or the ultraviolet generator 63 (e.g., a UV lamp) operates depending on the degree of pollution.

As shown in FIG. 7, the input unit 80 may include a button housing 81 and a plurality of buttons 82*a*, 82*b*, and 82*c* installed in the button housing 81, and each of the plurality of buttons 82*a*, 82*b*, and 82*c* may include a first button 82*a*, a second button 82*b*, and a third button 82*c* that perform a different function.

As shown in FIGS. 7 and 10A, the input unit 80 may be detachably coupled to the front body 31 by screw fastening, or the like. The front body 31 may be formed with a plurality of button holes 31*a*, 31*b*, 31*c* into which each of the plurality of buttons 82*a*, 82*b*, and 82*c* is inserted. Thus, a plurality of buttons 82*a*, 82*b*, and 82*c* are partially exposed on the front surface of the front body 31 so that the user can operate the button.

As an example, the first button 82*a* may be a button for rotating the receptacle 20 in the left-right direction, and may be a button for issuing a signal to the controller 90 to control the rotation direction and the rotation angle of the rotation motor 51. To this end, the controller 90 may be electrically connected to the first button 82*a* and the rotation motor 51.

For example, the second button 82*b* may be a button for discharging hot air or lukewarm air from the discharge port 3 of the dryer 1 mounted in the receptacle 20, and may be a button for issuing a signal to the controller 90 to control the operation of the heater that heats the air introduced into the dryer 1. To this end, the controller 90 may be electrically connected to the second button 82*b* and the heater of the dryer 1.

As an example, the third button 82*c* may be a button for purifying indoor air through the air purifier, and may be a button for issuing a signal to the controller 90 to control the operation of the fan 61 and the ultraviolet generator 63. To this end, the controller 90 may be electrically connected to the third button 82*c*, the fan 61, and the ultraviolet generator 63.

According to the embodiment, when the discharge port 3 of the dryer 1 is rotatably provided by a discharge port rotation motor built in the dryer 1, the stand may further include a fourth button. In such an arrangement, the fourth button may be a button for rotating the discharge port 3, and may be a button that issues a signal to the controller 90 to control the rotation of the discharge port rotation motor. To this end, the controller 90 may be electrically connected to the fourth button and the discharge port rotation motor.

The number of buttons provided in the input unit 80 described above and the function of each button are just an example, and are not limited thereto.

As shown in FIGS. 8 and 12, the stand according to an embodiment of the present disclosure may supply power to various components requiring power, such as the rotation motor 51, the fan 61, the ultraviolet generator 63, and the controller 90, through a power cable penetrating a power supply hole 123 formed in one side of the base 10.

In addition, according to an embodiment, a separate battery may be built in the stand to supply power to various components that require power in the stand. Such a battery may be charged by an external power source applied through the power cable.

The battery built in the dryer 1 mounted in the receptacle 20 may be charged through an external power source applied through the power cable and an electrode terminal passing through the terminal hole 221.

As shown in FIG. 14, the stand according to the embodiment of the present disclosure may include an output unit (D). The output unit D may be a display for displaying to the user whether a function of the stand is being performed by the stand. For example, the output unit D may display information such as the remaining power of the battery built in the dryer 1, the discharge of hot air or lukewarm air from the discharge port 3 of the dryer 1, the rotation operation of the discharge port of the dryer 1, the tilting or rotation angle in the left-right direction of the receptacle 20, the pollution degree of ambient air, and operation of the air purifier.

As shown in FIG. 13, the stand according to the embodiment of the present disclosure may be provided with a plurality of pads 135 on the bottom surface of the stand in order to prevent it from deviating from the installation position due to sliding on the ground or colliding with the drying target.

According to a configuration of the stand described above, the disposition of the air purifier, which may include a plurality of air purifiers described above, and the flow path of air passing through the air purifier may be schematically presented as shown in (a) of FIG. 12A. Additional exemplary arrangements will be discussed with reference to FIGS. 12A to 12F.

As shown in (a) of FIG. 12A, in a first embodiment, the fan 61 flows air from the lower side toward the upper side of the body, and the plurality of air purifiers may be disposed from the lower side toward the upper side. In this arrangement, a flow path of air passing through the air purifiers may be formed between the suction hole 121 formed in the middle base 12 and the discharge hole 131 formed in the rear body 32.

Figure 12B:
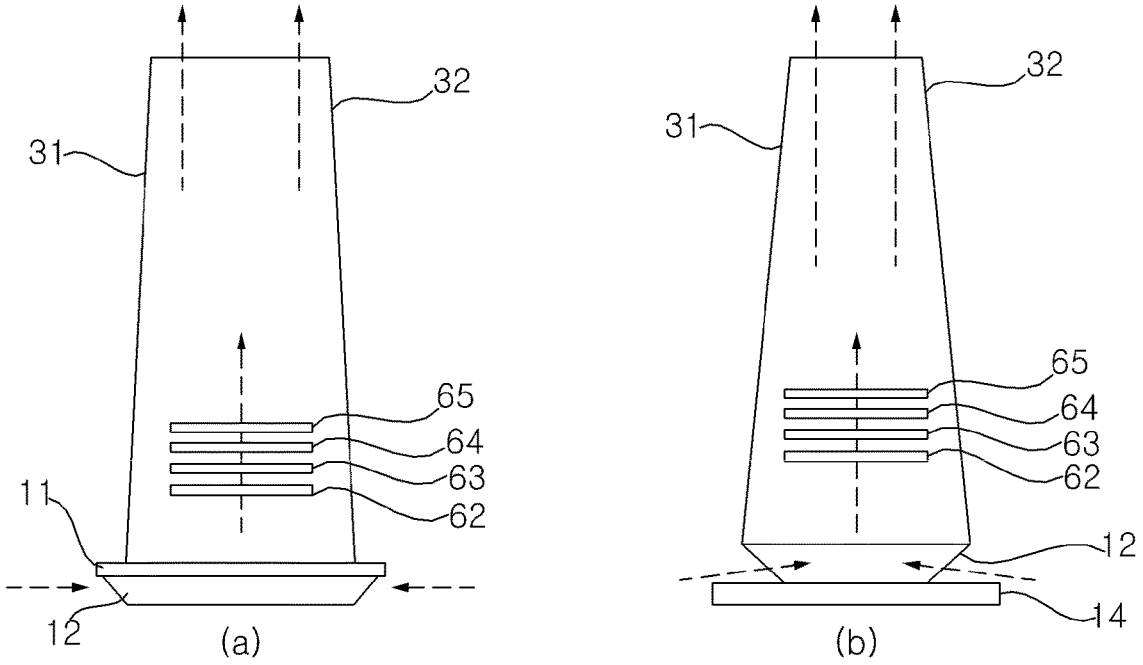

As shown in (a) of FIG. 12B, in a second embodiment, the fan 61 flows air from the lower side toward the upper side, and the plurality of air purifiers may be disposed from the lower side toward the upper side. In this arrangement, a flow path of air passing through the air purifiers may be formed between the suction hole 121 formed in the middle base 12, and a discharge hole provided between the upper body 34 and the receptacle 20.

Figure 12C:
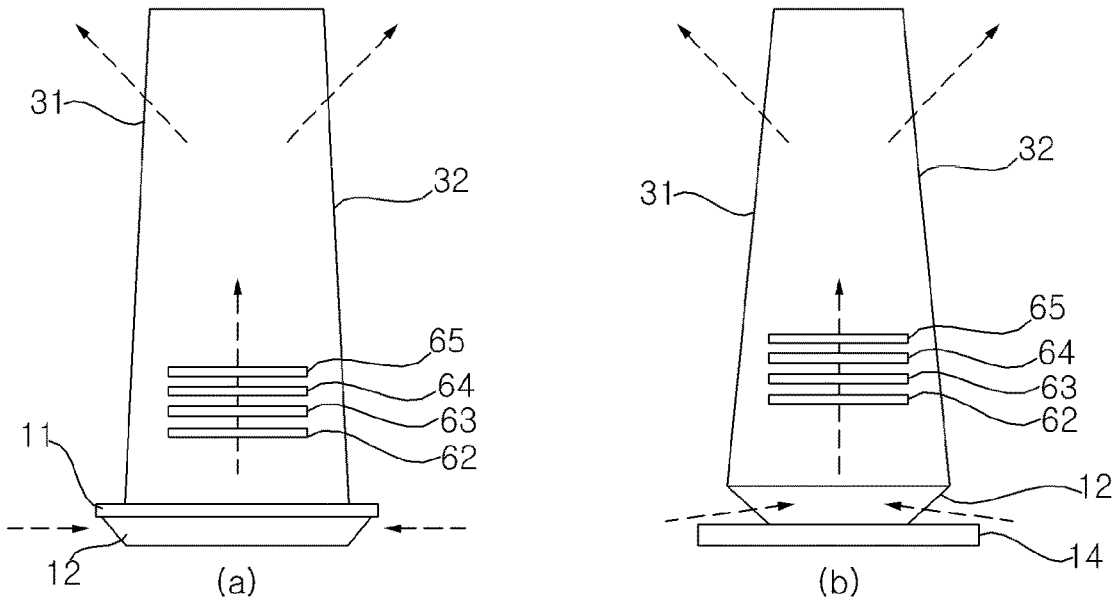

As shown in (a) of FIG. 12C, in a third embodiment, the fan 61 flows air from the lower side toward the upper side, and the plurality of air purifiers may be disposed from the lower side toward the upper side. In this arrangement, a flow path of air passing through the air purifiers may be formed between the suction hole 121 formed in the middle base 12, and a discharge hole formed in each of the front body 31 and the rear body 32.

Figure 12D:
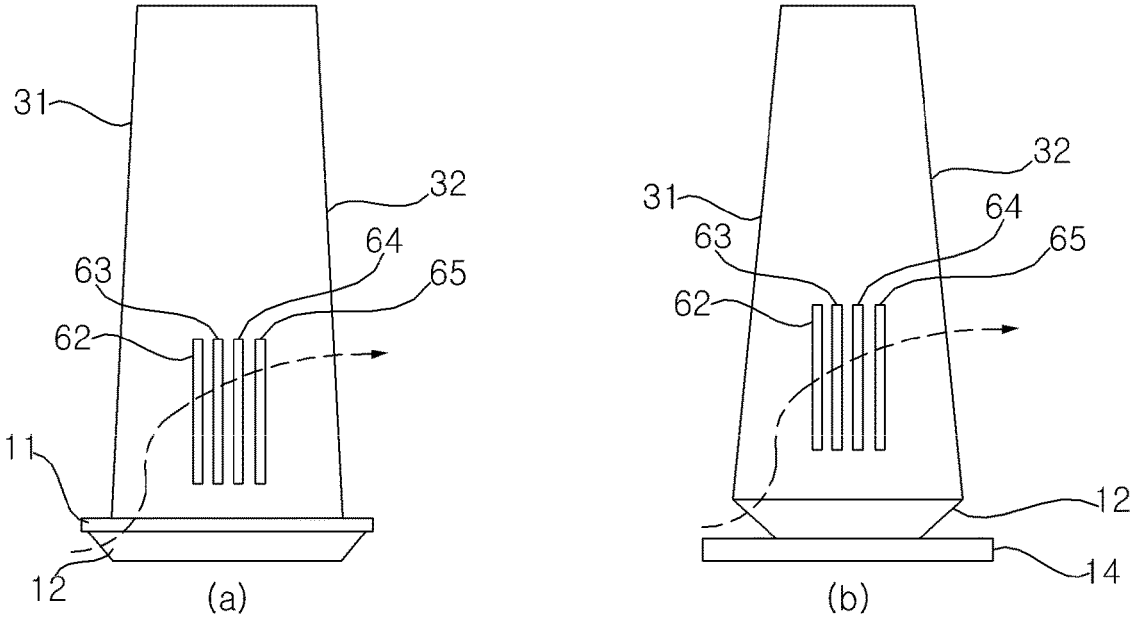

As shown in (a) of FIG. 12D, in a fourth embodiment, the fan 61 flows air from the left side toward the right side (or alternatively from the right side toward the left side), and the plurality of air purifiers may be disposed from the left side toward the right side (along an axis perpendicular to a longitudinal axis of the body 30). In this arrangement, a flow path of air passing through the air purifiers may be formed between the suction hole 121 formed in the middle base 12 and the discharge hole 321 formed in the rear body 32.

In addition, as shown in each of (b) of FIG. 12A, (b) of FIG. 12B, (b) of 12C, 12D, and (b) of 12D, each of the above-described first to fourth embodiments may be implemented where the stand further includes a base plate 14.

Alternative arrangements, in which the upper base 11, the middle base 12, and the lower base 13 may be omitted, and the base plate 14 is connected directly to the body 30 may be provided. In these alternative arrangements, the disposition of the air purifier implemented in the stand having the suction hole formed in the body 30 and the various possible air flow paths are shown in FIG. 12E.

Figure 12E:
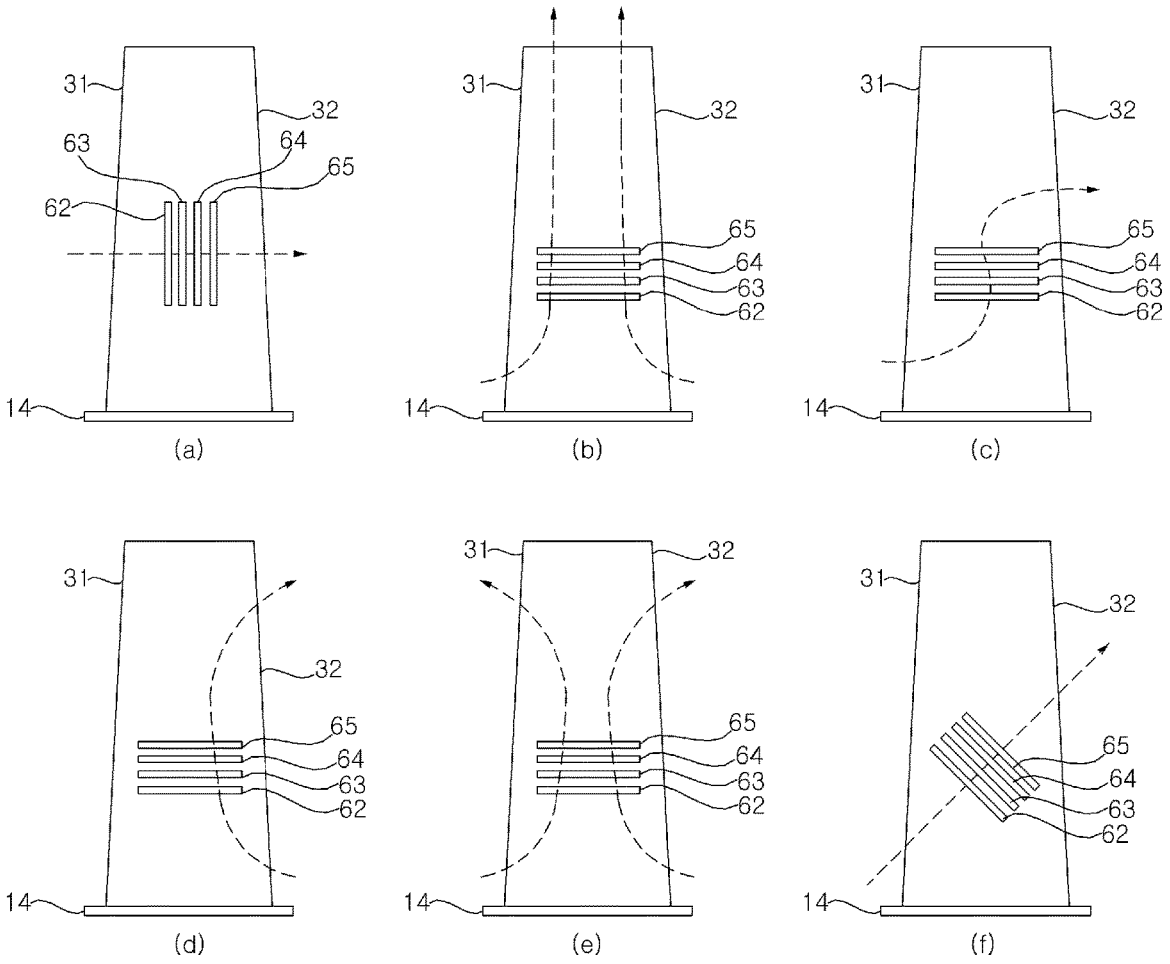

As shown in (a) of FIG. 12E, in a fifth embodiment, the fan 61 flows air from the front side toward the rear side, and the plurality of air purifiers may be disposed from the front side toward the rear side. In this arrangement, a flow path of air passing through the air purifiers may be formed between the suction hole formed in the front body 31 and the discharge hole formed in the rear body 32.

As shown in (b) of FIG. 12E, in a sixth embodiment, the fan 61 flows air from the lower side toward the upper side, and the plurality of air purifiers may be disposed from the lower side toward the upper side. In this arrangement, a flow path of air passing through the air purifiers may be formed between the suction hole formed in each of the front body 31 and the rear body 32, and the discharge hole formed between the upper body 34 and the receptacle 20.

As shown in (c) of FIG. 12E, in a seventh embodiment, the fan 61 flows air from the lower side toward the upper side, and the plurality of air purifiers may be disposed from the lower side toward the upper side. In this arrangement, a flow path of air passing through the air purifiers may be formed between the suction hole formed in the front body 31 and the discharge hole formed in the rear body 32.

As shown in (d) of FIG. 12E, in an eighth embodiment, the fan 61 flows air from the lower side toward the upper side, and the plurality of air purifiers may be disposed from the lower side toward the upper side. In this arrangement, a flow path of air passing through the air purifiers may be formed between the suction hole formed in the rear body 32 and the discharge hole formed in the rear body 32.

As shown in (e) of FIG. 12E, in a ninth embodiment, the fan 61 flows air from the lower side toward the upper side, and the plurality of air purifiers may be disposed from the lower side toward the upper side. In this arrangement, a flow path of air passing through the air purifiers may be formed between the suction hole formed in each of the front body 31 and the rear body 32 and the discharge hole formed in each of the front body 31 and the rear body 32.

As shown in (f) of FIG. 12E, in a tenth embodiment, the fan 61 flows air from the front lower side toward the rear upper side, and the plurality of air purifiers may be disposed from the front lower side toward the rear upper side. In this arrangement, a flow path of air passing through the air purifiers may be formed between the suction hole formed in the front body 31 and the discharge hole formed in the rear body 32.

Unlike the embodiments shown above, still other arrangements may be provided where the stand includes the upper base 11, the middle base 12, and the lower base 13 and a discharge hole is provided in the middle base. In these arrangements, the disposition of the air purifier implemented in the stand having the discharge hole formed in the middle base 12 and the various possible air flow paths are shown in in FIG. 12F.

Figure 12F:
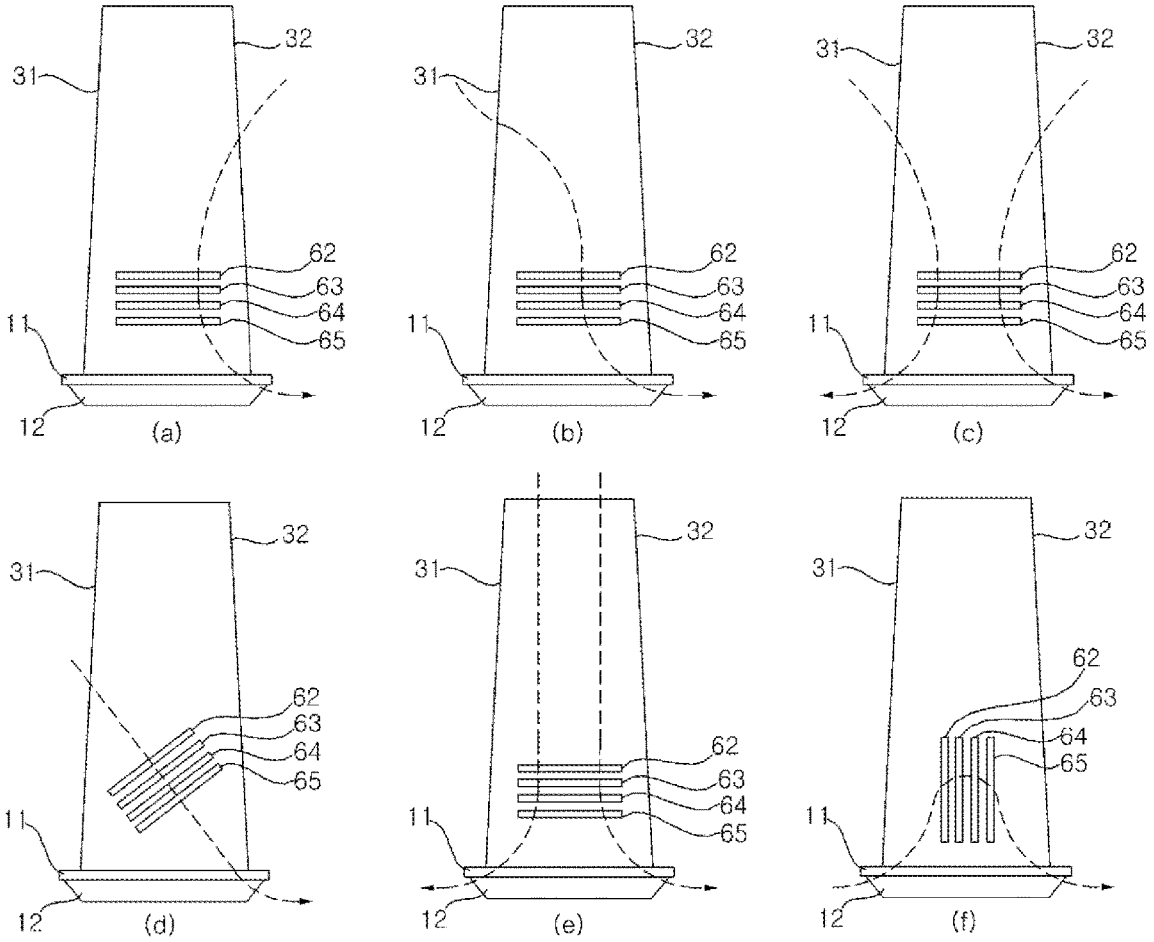

As shown in (a) of FIG. 12F, in an eleventh embodiment, the fan 61 flows air from the upper side toward the lower side, and the plurality of air purifiers may be disposed from the upper side toward the lower side. In this arrangement, a flow path of air passing through the air purifiers may be formed between the suction hole formed in the rear body 32 and the discharge hole formed in the middle base 12.

As shown in (b) of FIG. 12F, in a twelfth embodiment, the fan 61 flows air from the upper side toward the lower side, and the plurality of air purifiers may be disposed from the upper side toward the lower side. In this case, a flow path of air passing through the air purifiers may be formed between the suction hole formed in the front body 31 and the discharge hole formed in the middle base 12.

As shown in (c) of FIG. 12F, in a thirteenth embodiment, the fan 61 flows air from the upper side toward the lower side, and the plurality of air purifiers may be disposed from the upper side toward the lower side. In this arrangement, a flow path of air passing through the air purifiers may be formed between the suction hole formed in each of the front body 31 and the rear body 32, and the discharge hole formed in each of the front and rear of the middle base 12.

As shown in (d) of FIG. 12F, in a fourteenth embodiment, the fan 61 flows air from the front upper side toward the rear lower side, and the plurality of air purifiers may be disposed from the front upper side to the rear lower side. In this arrangement, a flow path of air passing through the air purifiers may be formed between the suction hole formed in the front body 31 and the discharge hole formed in the middle base 12.

As shown in (e) of FIG. 12F, in a fifteenth embodiment, the fan 61 flows air from the upper side toward the lower side, and the plurality of air purifiers may be disposed from the upper side toward the lower side. In this arrangement, a flow path of air passing through the air purifiers may be formed between the suction hole formed between the upper body 34 and the receptacle 20, and the discharge hole formed in each of the front and rear of the middle base 12.

As shown in (f) of FIG. 12F, in a sixteenth embodiment, the fan 61 flows air from the front side toward the rear side, and the plurality of air purifiers may be disposed from the front side toward the rear side. In this case, a flow path of air passing through the air purifiers may be formed between the suction hole formed in the front side of the middle base 12 and the discharge hole formed in the rear side of the middle base 12.

The stand according to an embodiment of the present disclosure described through the first to sixteenth embodiments may increase the air purification rate while minimizing the volume occupied by the air purifier inside the stand.

According to the present disclosure, one or more of the following effects may be achieved.

First, since the dryer may be mounted in the receptacle, the user can dry the drying target without holding the dryer.

Second, since the air purifier may be provided, the indoor air can be purified separately from the mounting of the dryer.

Third, the air purifier may be disposed in the flow path of the air induced by the fan, thereby increasing the air purification rate while minimizing the volume occupied by the air purifier inside the stand.

Fourth, the side surface of the base on which the suction hole is formed may be inclined toward the inner side as it progresses from the upper end to the lower end, thereby preventing liquid such as water falling toward the bottom from being introduced into the stand through the suction hole.

Fifth, the controller may be disposed in the flow path of air induced by the fan, thereby effectively removing the heat generated by the controller.

Although the exemplary embodiments of the present disclosure have been disclosed for illustrative purposes, those skilled in the art will appreciate that various modifications, additions and substitutions are possible, without departing from the scope and spirit of the disclosure as disclosed in the accompanying claims. Accordingly, the scope of the present disclosure is not construed as being limited to the described embodiments but is defined by the appended claims as well as equivalents thereto.

What is claimed is:

1. A dryer stand, comprising:

a base having a suction hole;

a body having a first end connected to the base and a second end spaced upward from the base;

a receptacle located in the second end of the body, the receptacle configured to receive a dryer for discharging drying air;

a fan located in the body to cause a flow of air to be introduced into the body through the suction hole and to be discharged outside the body; and an air purifier disposed in a flow path of the flow of air, wherein the base has a side surface in which the suction hole is located, and wherein the side surface is inclined inward as it extends from an upper end thereof to a lower end thereof.

2. The dryer stand of claim 1, wherein the base comprises:

an upper base having an upper side and a lower side, the body being connected the upper side;

a middle base coupled to the lower side of the upper base, the middle base having a lower side; and a lower base coupled to the lower side of the middle base.

3. The dryer stand of claim 2, wherein the base further comprises a base plate coupled to a lower side of the lower base, the base plate having a larger width than a width of the body.

4. The dryer stand of claim 2, wherein the middle base has the side surface in which the suction hole is located, and wherein the suction hole is provided as a plurality of suction holes such that the suction holes are spaced apart from each other at a predetermined interval.

5. The dryer stand of claim 4, wherein the side surface is inclined inward as it extends from the lower side of the upper base to the lower base.

6. The dryer stand of claim 2, further comprising a filter located in an inner surface of the middle base to filter foreign matter in the flow of air introduced through the suction hole.

7. The dryer stand of claim 2, further comprising a controller located in the lower base and disposed in the flow path of the flow of air, the controller being configured to control the operation of the fan and the air purifier.

8. The dryer stand of claim 1, wherein the flow of air flows in an upward direction in the body, and wherein the air purifier is a plurality of air purifiers that are spaced apart from each other in the upward direction of the flow of air.

9. The dryer stand of claim 1, wherein the flow of air flows in a direction perpendicular to a longitudinal axis of the body, and wherein the air purifier is a plurality of air purifiers that are spaced apart from each other in the direction perpendicular to the longitudinal axis of the body.

10. The dryer stand of claim 1, wherein the body comprises:

an upper body, the upper body being adjacent to an upper portion of the receptacle at the second end of the body; and a side body being disposed between the upper body and the base.

11. The dryer stand of claim 10, wherein the side body includes a discharge hole, and wherein the flow path of the flow of air extends from the suction hole to the discharge hole.

12. The dryer stand of claim 10, wherein a discharge hole is provided between the upper body and the receptacle, and wherein the flow path of the flow of air extends from the suction hole to the discharge hole.

13. The dryer stand of claim 10, further comprising an inner body located within the body, wherein the inner body includes a discharge hole, and wherein the side body includes a discharge hole.

* * * * *